US005653352A

United States Patent [19]

Kim

[11] Patent Number: 5,653,352

[45] Date of Patent: Aug. 5, 1997

[54] AIR COMPRESSION-TYPE CAP DESIGNED TO PRESERVE THE TASTE OF BOTTLED DRINKS

[76] Inventor: Kijung Kim, 1/1, 180, Dongsam 3 dong, Yongdo-ku, Pusan, Rep. of Korea

[21] Appl. No.: 441,444

[22] Filed: May 15, 1995

[30] Foreign Application Priority Data

Apr. 20, 1995 [KR] Rep. of Korea ..... 95-8444

[51] Int. Cl.[6] ..... B65D 51/24

[52] U.S. Cl. ..... 215/228; 220/212

[58] Field of Search ..... 220/212; 215/228, 215/260; 141/65, 64, 27; 417/553, 554

[56] References Cited

U.S. PATENT DOCUMENTS

| | | | |
|---|---|---|---|
| 4,515,019 | 5/1985 | Woodfill | 215/228 X |
| 4,723,670 | 2/1988 | Robinson et al. | 215/228 |
| 4,763,802 | 8/1988 | Johnston | 215/228 |
| 5,031,785 | 7/1991 | Lemme | 215/228 |
| 5,207,339 | 5/1993 | Shyu | 215/228 |
| 5,294,010 | 3/1994 | Tschida | 215/228 |
| 5,322,094 | 6/1994 | Janesko | 141/65 |

*Primary Examiner*—Allan N. Shoap
*Assistant Examiner*—Nathan Newhouse
*Attorney, Agent, or Firm*—Notaro & Michalos

[57] ABSTRACT

A resealable cap for a drink bottle having a pump for pressurizing a liquid in the bottle and a tight sealing connection with a threaded bottle neck. The pump is a tube having a soft resinous stepped base within a cylinder which extends downward through the neck into the interior of the bottle. A seal is formed between the base of the tube and the cylinder wall. At the base of the cylinder is a valve for allowing air compressed by the soft base and tube to flow into the bottle and which is sealed shut by the higher pressure created in the bottle when the soft base is retracted. The soft base has a small expandable slit adjacent the tube and above the step forming the seal through which deforms so that air can enter the cylinder on the upstroke. The slit is compressed closed on the downstroke and prevents air from leaving so it is instead forced through the valve.

2 Claims, 6 Drawing Sheets

AIR COMPRESSION-TYPE CAP DESIGNED TO PRESERVE THE TASTE OF BOTTLED DRINKS

Figures 1, 1A:
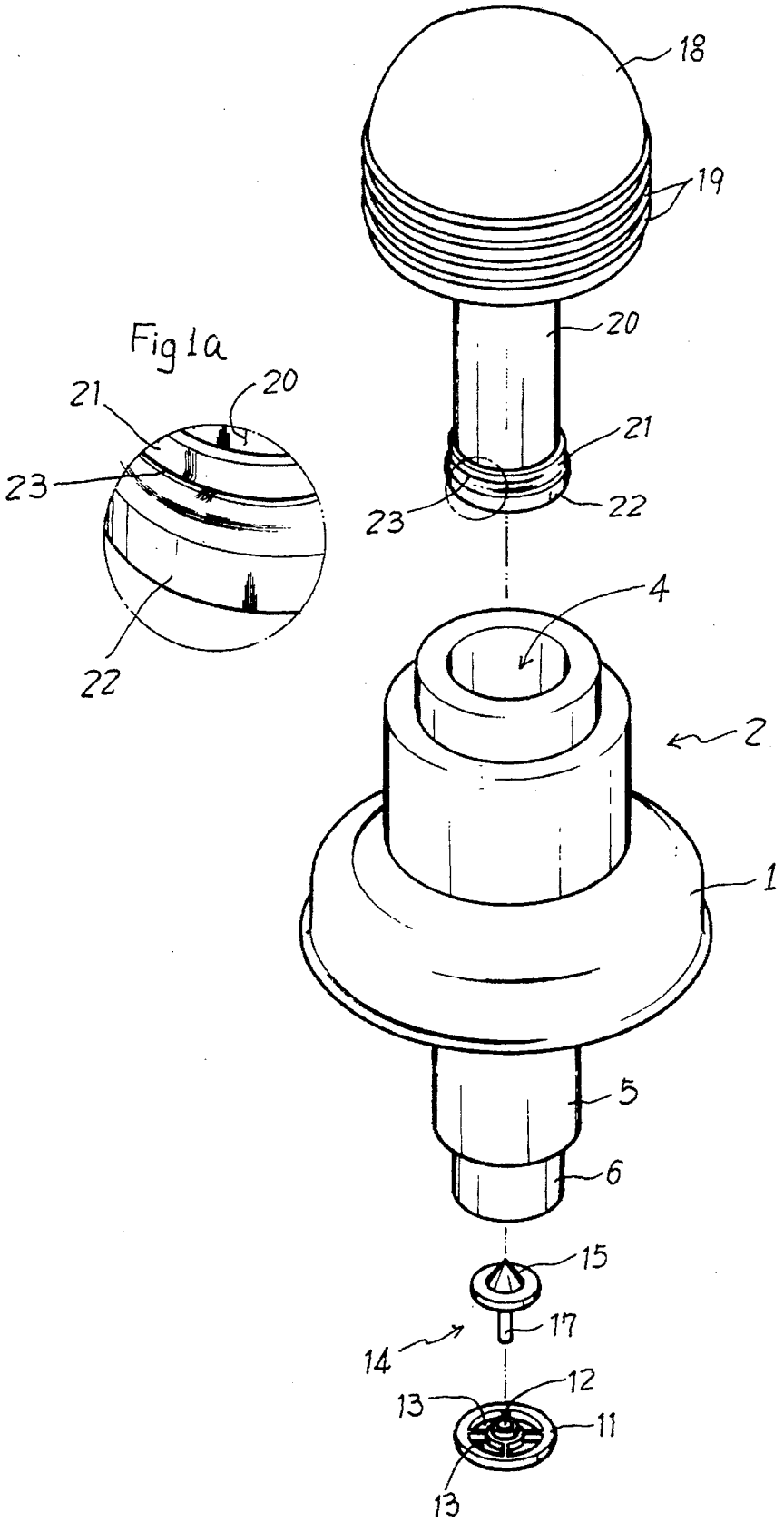
FIG. 1 is a disassembled perspective view of the present invention, FIG. 1*a* being an enlarged partial view of a portion of FIG. 1.
Figure 2:
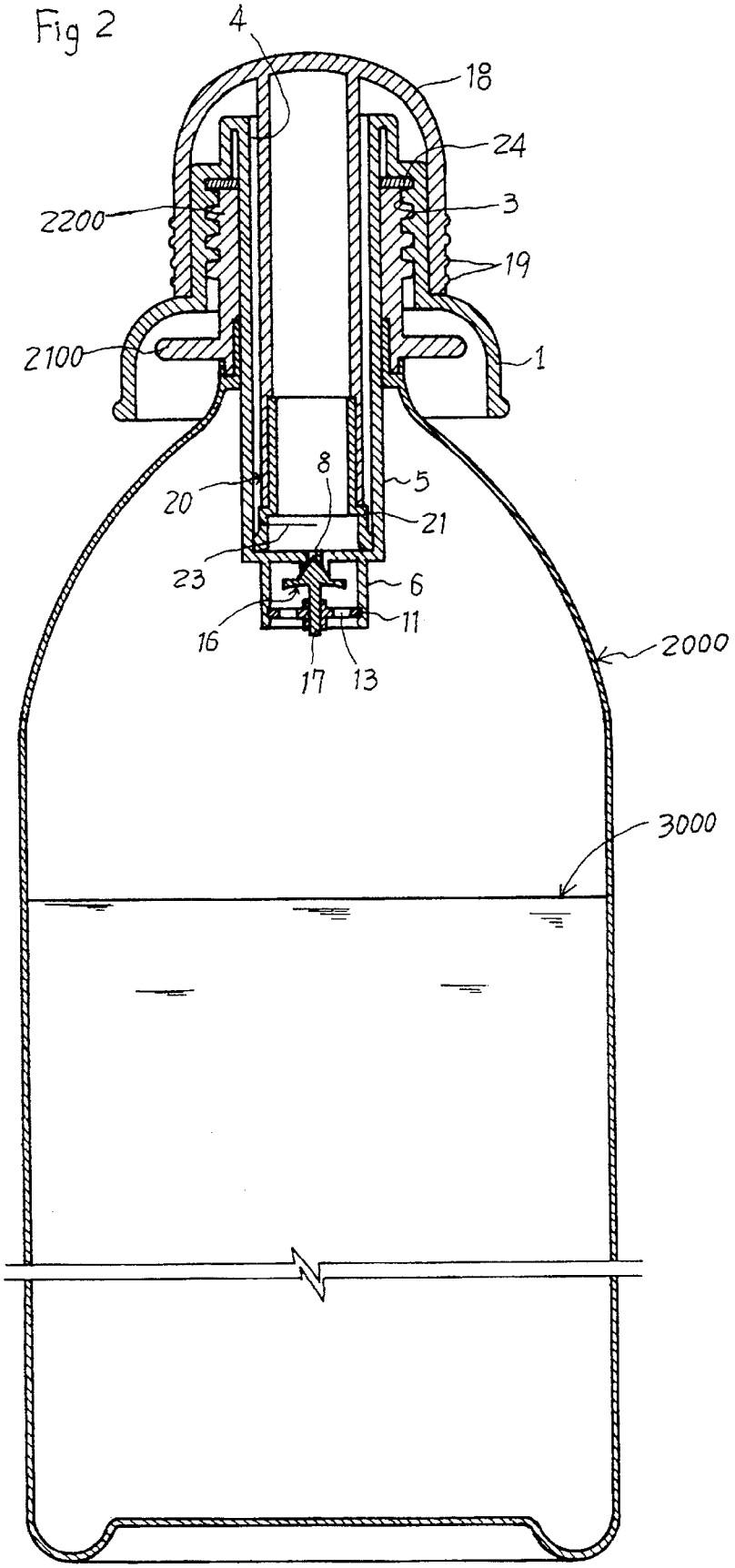
FIG. 2 is a sectional view showing that the present invention is in use.

*Description of the symbols standing for major parts of the figures

1. Main body
2. Step-like jaw part
3. Screw
4. Hole
5. Tubular body
6. Projecting tube
7. Air tube
8. Hole
9. Inclined plane
10. Groove
11. Stopping plate
12. Tubular part
13. Hole
14. Tight closer
15. Cone
16. Curved part
17. Bar
18. Handle
19. Protruding ring
20. Tubular body
21. Soft resinous tubular body
22. Step-like jaw
23. Cut-open line
24. Tight closing ring
25. Step-like jaw
100. Main body
200. Handle
300, 600. Through hole
400, 700. Bearing
500, 800. Spring
900. Fitting tube
1000. Bottle
2000. Resinous bottle
3000. Drink
2100. Projecting wing
2200. Bottle mouth
3000. Drink

DETAILED DESCRIPTION OF THE INVENTION

The present invention relates to an air compression-type cap designed to keep the fresh flavor and biting taste of a drink nearly as it is, that is, to preserve the original flavor of a drink even after the drink(3000) containing carbonic acid gas is taken from a resinous bottle to some extent.

A bottled drink containing carbonic acid gas evaporates the carbonic acid gas as soon as its cap is removed and loses its original flavor and biting taste as time goes by.

It is said that air pressure amounting to 3–4 mb is filled in resinous bottles(2000) or glass bottles. Once the cap is taken off, pressure declines quickly and carbonic acid gas evaporates slowly and completely with the lapse of time.

Consequently, aroma and taste are snuffed out to such an extent that the remaining drink is thrown away in most cases.

Although the pressure of carbonic acid gas contained in the remaining drink can be kept to a certain extent if a cap is tightly put to the bottle after a drink is taken ⅓ or ½, and so aroma and taste are thereby kept from being completely distinguished, carbonic acid gas is still vaporized and filled in a space within the bottle formed by discharging the drink, and so the aroma and taste of the remaining drink sustain a loss and pressure leaks through a very small chink in the cap. Even in this case, the aroma and taste of the drink are also distinguished with the lapse of time.

Figure 8:
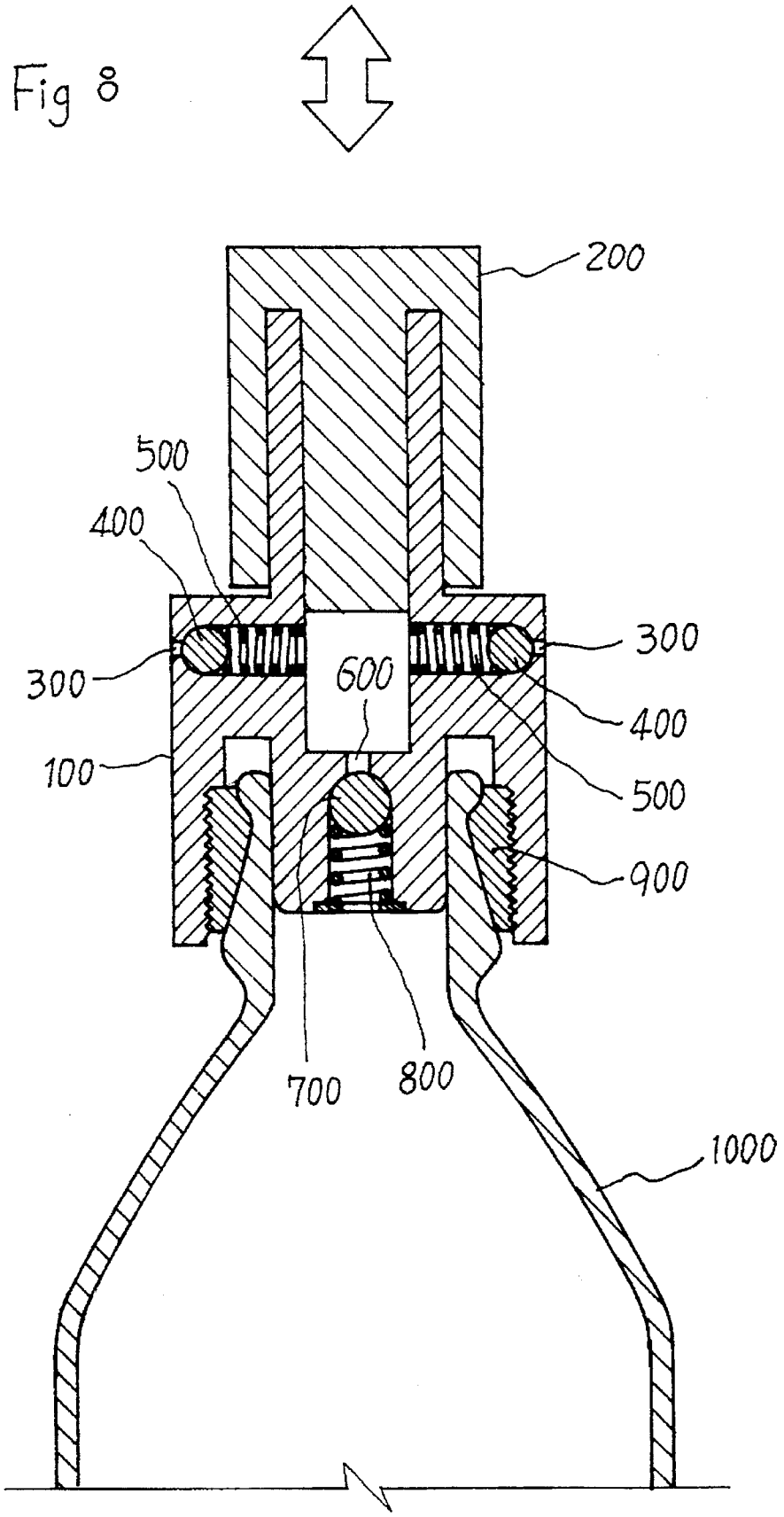
FIG. 8 is a reference diagram showing a known air compression-type cap.

Paying attention to a scientific ground that carbonic acid gas contained in the remaining drink is not vaporized and the original taste and aroma are thereby kept to the fullest extent if internal pressure of a bottle is kept as near as the original state even after a drink is taken to a certain extent, an air compression-type cap has been developed as illustrated in FIG. 8, wherein a fitting tube(900) provided with a screw outward is fitted to the mouth of a bottle(1000) and a main body(100) in which a check valve comprising two bearings (400) and two springs(500) is formed left and right in the upper part and a check valve comprising a bearing(700) and a spring(8OO) is formed in the internal lower part is spirally united with the fitting tube(900), but the lower check valve is inserted into the mouth of a bottle and the outside air is made to flow in through a through hole(300) by moving a handle(200) up and down for filling up in the interior of the bottle through a through hole(600).

However, the cap heretofore in use is unclean because those bearings(400)(700) are rusted, and unsanitary because rusty powder enters the bottle. When the bearings are rusted, effectiveness of airtight closing is lowered so remarkably that a desired purpose is not accomplished and the cap must be changed for new one. Moreover, manufacture of the cap is not so easy that it rises in cost. As the fitting tube(900) must be provided separately, it is uneconomical. It is also troublesome to fit and take it out. As the main body must be assembled after the fitting tube(900) is fitted, it is inconvenient to use. Since it is possible to use the conventional cap only for a bottle with a hollow groove in the mouth, it can not be used for a resinous bottle, so that it is not used commonly.

As to the present invention, it is contrived to provide an air compression-type cap which is made of plastic, suitable for use in resinous bottles(200) and simple in structure, excellent in effectivesness of airtight closing and sanitary in use.

The constitution of the present invention will now be described in detail according to the drawings attached hereto.

A tubular body(5) in which a step-like jaw part(2) is formed upward, a screw is formed in the inner side of the step-like jaw part(2) and a hole(4) is made upward for connection with the main body(1) the lower part of which becomes wider like a trumpet is formed, but an air tube(7) having a hole(8) and an inclined plane(9) is formed below the tubular body(5), and a stopping plate(11) so formed as to enable a bar(17) of a tight closer(14) to be put into a tubular part(12) by forming a projecting tube(6) having a groove (10) in the lower inner side under the tubular body(5) is put into the groove(10) of the projecting tube(6), but the tight closer(14) is formed so as to have a pointed cone(15) upward and a curved part(16) downward, and several holes(13) are formed around the tubular part(12) of the stopping plate(11), and a soft resinous tubular body(21) and a tubular body(20) of a handle(18) so formed as to form the soft resinous tubular body(21) in the lower part of the tubular body(20) by forming several protruding rings(19) outward and installing the tubular body(20) in the center on the inner side are put into the hole(4) of the main body(1), but the outside diameter of a step-like jaw(22) of the resinous tubular body(21) is properly put to the inside diameter of the hole(4), and a cut-open line(23) is formed on the upside of the step-like jaw(22) to half the circumferential length thereof and, after a tight closing ring(24) is placed on the mouth(2200) of the bottle and the main body(1) is spirally united with the mouth(2200), pumping operations are conducted by moving the handle(18) up and down. The cut-open line(23) formed in the soft resinous tubular body(21) lets air flow in with chinks becoming wider when distorted inward because internal pressure declines when the soft resinous tubular body(21) rises together with the tubular body(20). When the tubular body(20) and soft resinous tubular body(21) come down, the chinks in the cut-open line(23) are tightly closed according as internal pressure of the hole(4) rises, and compressed air pushes the tight closer(14) to be filled up in the resinous drink bottle(2000) through the hole(8). The tight closer(14) automatically rises and tightly closes the hole(8) in the air tube(7) by the air pressure filled up in the resinous drink bottle(2000).

Now, working and effect of the present invention will be described.

The screw(3) on the inner side of the main body(1) is to be united with a screw part formed in the mouth(2200) of a usual resinous drink bottle(2000). When the tight clsoing ring(24) is placed on the mouth(2200) and the main body(1) is spirally united therewith, a tight closing effect is certain.

At this time, the tubular body(5) is inserted into the resinous drink bottle(2000). The tubular body(20) and soft resinous tubular body(21) of the handle(18) are inserted into the hole(4). The edge of the handle(18) is softly attached to the step-like jaw part(2) of the main body(1) upon contact therewith.

The lower part of the main body(1), namely, the part which becomes wider like a trumpet covers the projecting wing(2100) to keep it from being exposed to the outside and it is thereby made to be sanitary.

If the handle(18) is operated upward and downward when a drink(3000) is left half of the resinous bottle(2000) after the invention is fixed up as illustrarted, pumping is effected and the outside air is filled in the resinous bottle. A detailed explanation will be given subsequent thereto.

Figure 3:
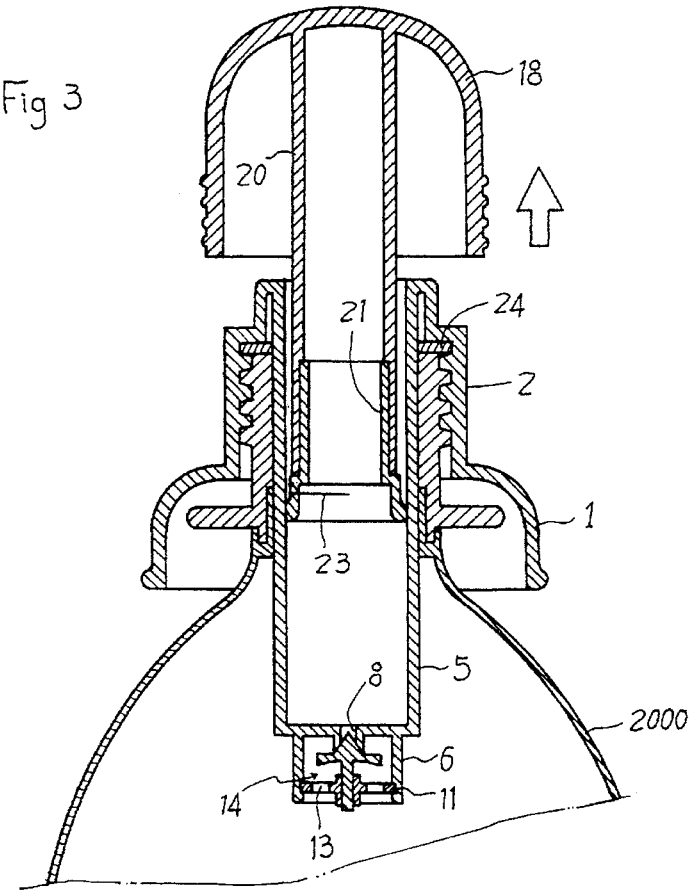
FIGS. 3 and 4 are sectional views showing the method of using the present invention.

When the handle(18) is raised as shown in FIG. 3, the soft resinous tubular body(21) rises together with the tubular body(2O). When the soft resinous tubular body(21) rises, pressure of the hole(4) and internal space of the tubular body(2O) is lowered as the step-like jaw(22) of the soft resinous tubular body(21) is arranged to be properly inserted into the hole(4) of the tubular body(5).

Then the soft resinous tubular body(21) is distorted inward and the cut-open line(23) which is finely cut open becomes open. Consequently, the outside air flows into the hole(4) and to the inner side of the tubular body(20).

When the handle(18) is lowered, pressure of the hole(4) and tubular body(20) rises. This pressure being applied to the soft resinous tubular body(21) to swell it outward, the cut-open line(23) sticks fast without a gap.

Figure 4:
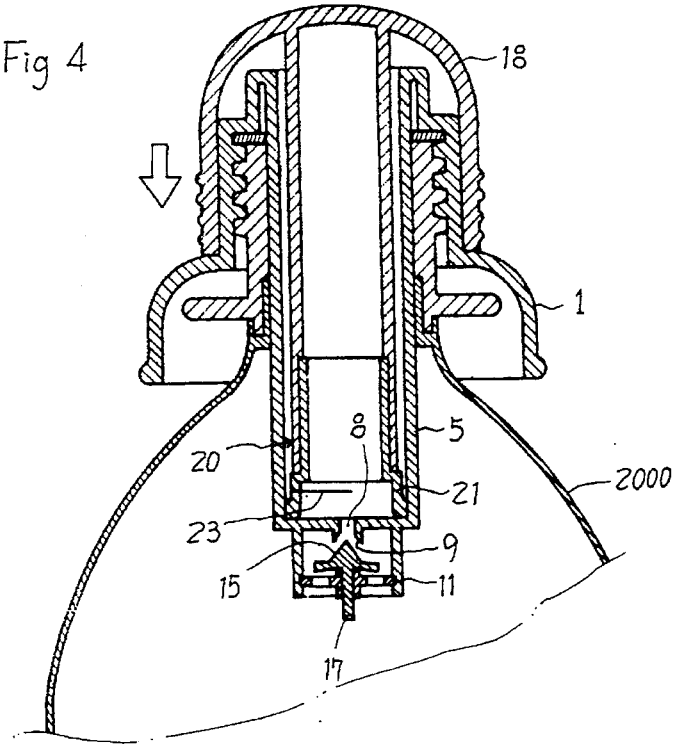
Figure 5:
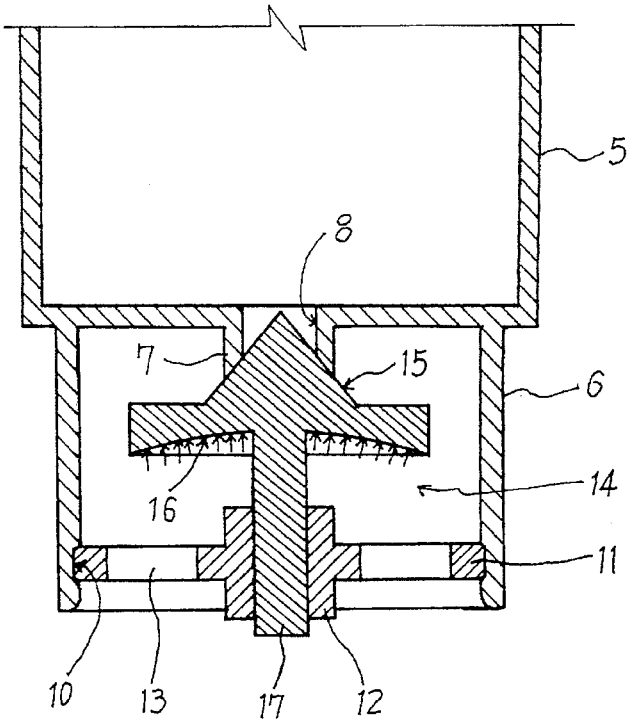
FIGS. 5 and 6 are sectional views showing that the important parts of the present invention are operated.
Figure 6:
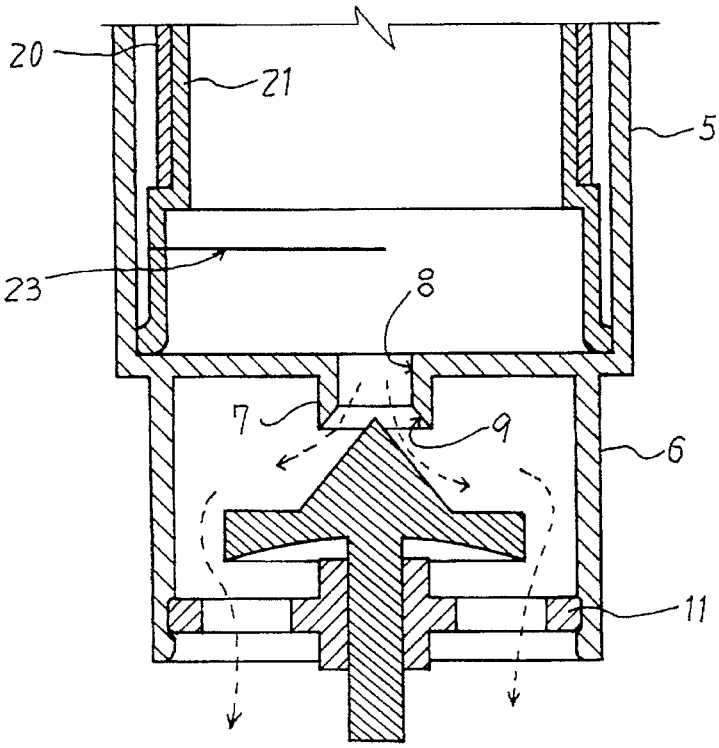

If the handle(18) is brought down lowermost in such a condition as shown in FIG. 4, high-pressure air in the hole(4) and in the inside of the tubular(20) pushes the tight closer (14) and is filled up in the resinous bottle(2000) through the hole(8) and through the hole(13).

The tight closer(14) is pushed upward by air pressure filled up in the resinous bottle(2000) and tightly closes the hole(5) of the air tube(7).

The tight closer(14) is stuck fast to an inclined plane of the air tube(7) most ideally as a cone(15) is formed thereon and promotes the effect of being closed tightly by taking its center automatically.

When pumping operations continue, pressure in the resinous bottle(2000) rises and reaches a point where no more air can be filled. This is the best condition.

At this time, carbonic acid gas contained in the remaining drink(3000) is not vaporized in the space of the resinous bottle(2000) and remains in the drink. From this time on, the taste of the drink is preserved well.

Therefore, the original aroma and taste are nearly preserved even if the drink is taken by undoing the main body(1) after the lapse of many hours, and so fresh and tasty drink can be taken.

As the present invention uses no parts which become rusty nor springs, it is sanitary in use and simple in structure and therefore low in cost. It being particularly high in tight closing effect, it accomplishes its object most satisfactorily.

The present invention is a contrivance which is economical as it is lower in unit price than the product heretofore in use, sanitary as it is not rusty, readily salable as it is lighter in weight and more satisfactory in tight closing effect and consummates the function of the check valve without using unnecessary parts by being so refined as to enable the outside air to flow in by means of the cut-open line(23) formed in the soft resinous tubular body(21).

The curved part(16) of the tight closer(14) is formed to enable rising pressure to be applied to the tight closer(14). An experiment conducted proves that the curved part is more effective than the flat part.

Figure 7:
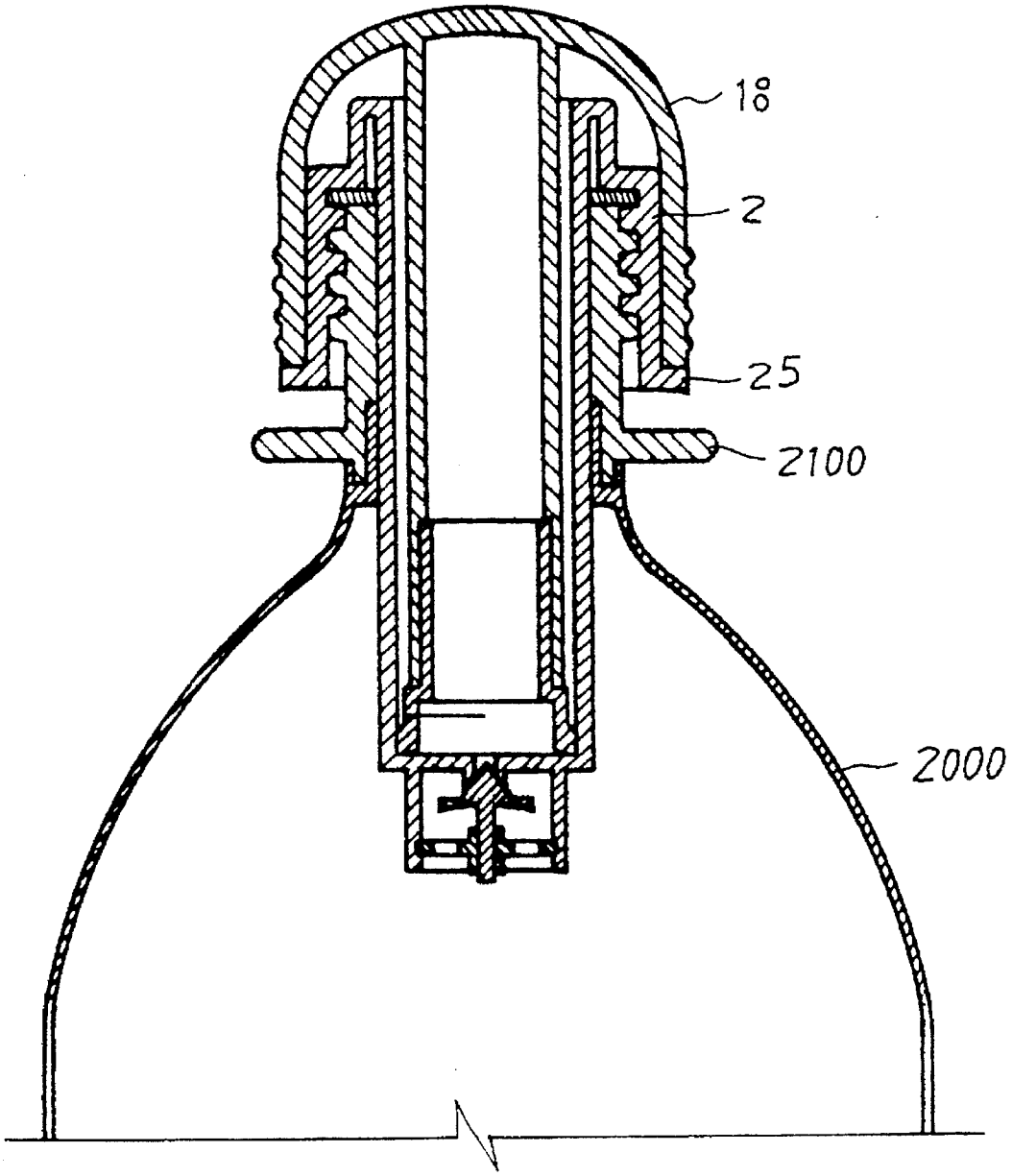
FIG. 7 is a secional view showing a dependent example of the present invention.

FIG. 7 is a dependent example of the present invention. It illustrates that the lower part which becomes wider in the main body(1) like a trumpet is left out and the step-like jaw(25) is formed for contact with the lower part of the handle(18). This has the characteristic of lowering the production cost and being simple in appearance, so that there is an ample hope for application and it is more effective for a small resinous bottle.

The cone(15) of the tight closer(14) may have the form of a semicircular globe with the mouth not sharpened, In place of the cone (15), a bar which can be properly fitted to the inside diameter of the hole(8) may be formed. As to the cut-open line(23), it may be formed longer or shorter than the half of the resinous tubular body(21) or a little in several places and the main body may be transparent or semitransparent with a beautiful color tone. However, it is self-evident that those modifications are included in the technical scope of the present invention.

I claim:

1. A resealable cap for compressing the air within a bottle having a threaded neck to preserve the taste of a drink contained by the bottle, the cap comprising:

a first tubular body, having a top end, a base end, the body defining a cylindrical hole therethrough between the top end and the base end, the cylindrical hole having a hole diameter;

a base plate at the base end having an opening therethrough, the opening having tapered edges, the taper toward the top end;

a main tubular body rigidly connected to the first tubular body adjacent the top end with a stepped part, the main tubular body extending downwardly, surrounding an upper portion of the first tubular body, having an interior wall and an exterior wall, the interior wall of the main tubular body and the first tubular body defining a gap therebetween, the interior wall adjacent the stepped part being threaded for connecting around the bottle threaded neck;

a tight closing ring removably attached to the stepped part within the gap between the first tubular body and the main tubular body;

a projecting tube connected at one end to the base plate of the first tubular body around the opening;

a stopping plate connected at the other end of the projecting tube, the stopping plate having a central tubular part aligned with the opening in the base plate, and a plurality of plate air holes surrounding the central tubular part;

a bar having a cone end and a free end, the bar slidably engaged within the central tubular part of the stopping plate;

a cone having a base and a point, the base rigidly connected to the bar at the cone end, the base having a diameter larger than a diameter of the central tubular part, the point of the cone being aligned with the opening-in the base plate, and the cone having a shape reciprocal to the tapered edge of the opening for making a tight seal with the tapered edge when the cone is in contact with the tapered edge;

a plunger tubular body having a bottom end and a handle end placed within the cylindrical hole of the first tubular body and slidable within the hole;

a soft resinous cylindrical body securely attached to the bottom end of the plunger tubular body, the soft resinous cylindrical body having a soft upper cylinder and a soft lower cylinder, the soft lower cylinder having a lower cylinder diameter equal to the hole diameter, the soft upper cylinder having a horizontal slit of a length approximately equal to half of a circumference of the soft upper cylinder, an upper cylinder diameter of the soft upper cylinder being smaller than the lower cylinder diameter; and a cylindrical plunger handle, having one end sealably connected over the handle end of the plunger tubular body, the other end of the handle being open, the handle surrounding the main tubular body.

2. A resealable cap according to claim 1, wherein the main tubular body has a protruding step at an end of the main tubular body opposite the stepped part.

* * * * *